US008172007B2

(12) United States Patent
Dolman et al.

(10) Patent No.: US 8,172,007 B2
(45) Date of Patent: May 8, 2012

(54) SYSTEM AND METHOD OF MONITORING FLOW IN A WELLBORE

(75) Inventors: Lee Dolman, Paris (FR); Louise Bailey, Cambridgeshire (GB); Ashley B. Johnson, Cambridge (GB); Alistair Oag, Aberdeen (GB)

(73) Assignee: IntelliServ, LLC., Houston, TX (US)

( * ) Notice: Subject to any disclaimer, the term of this patent is extended or adjusted under 35 U.S.C. 154(b) by 284 days.

(21) Appl. No.: 12/364,372

(22) Filed: Feb. 2, 2009

(65) Prior Publication Data

US 2010/0193184 A1 Aug. 5, 2010

Related U.S. Application Data

(63) Continuation-in-part of application No. 11/995,518, filed on Dec. 13, 2007, now abandoned.

(51) Int. Cl.
*E21B 7/00* (2006.01)

(52) U.S. Cl. .. 175/57; 175/42; 166/250.11; 166/250.12; 166/254.1; 166/255.1

(58) Field of Classification Search ..... 166/250.11, 166/250.12, 254.1, 255.1, 66; 175/42, 57
See application file for complete search history.

(56) References Cited

U.S. PATENT DOCUMENTS

| | | | | |
|---|---|---|---|---|
| 4,447,340 | A | 5/1984 | FeJean-Jacques | |
| 4,807,469 | A | 2/1989 | Hall | |
| 5,243,190 | A | 9/1993 | Bandy et al. | |
| 6,125,934 | A | 10/2000 | Lenn et al. | |
| 6,176,323 | B1 * | 1/2001 | Weirich et al. | 175/40 |
| 6,324,904 | B1 * | 12/2001 | Ishikawa et al. | 73/152.03 |
| 6,564,866 | B2 | 5/2003 | Clark et al. | |
| 6,577,244 | B1 | 6/2003 | Clark et al. | |
| 6,641,434 | B2 | 11/2003 | Boyle et al. | |
| 6,704,109 | B2 | 3/2004 | Wu et al. | |
| 6,707,556 | B2 | 3/2004 | Turner et al. | |
| 6,745,833 | B2 * | 6/2004 | Aronstam et al. | 166/250.11 |
| 6,866,306 | B2 | 3/2005 | Boyle et al. | |
| 6,935,425 | B2 * | 8/2005 | Aronstam | 166/250.11 |
| 6,950,034 | B2 | 9/2005 | Pacault et al. | |
| 6,995,217 | B2 | 2/2006 | Agapion et al. | |
| 7,017,662 | B2 * | 3/2006 | Schultz et al. | 166/254.2 |
| 7,040,415 | B2 | 5/2006 | Boyle et al. | |

(Continued)

FOREIGN PATENT DOCUMENTS

WO WO0142622 6/2001

OTHER PUBLICATIONS

PCT International Search Report and Written Opinion Dated Aug. 31, 2010 for Appl. No. PCT/US2010/022917; (8 p.).

*Primary Examiner* — Jennifer H Gay
*Assistant Examiner* — Elizabeth Gottlieb
(74) *Attorney, Agent, or Firm* — Conley Rose, P.C.

(57) ABSTRACT

A system and method for releasing a marker within a wellbore. The system and method includes a sensor that detects movement or a position of the marker within the wellbore. The marker may be released in drilling fluid, for example, and may travel from the surface to the drill bit and return to the surface with cuttings. As an example, the markers are used to determine the flow of cuttings within the wellbore.

21 Claims, 3 Drawing Sheets

U.S. PATENT DOCUMENTS

| | | | | |
|---|---|---|---|---|
| 7,084,392 | B2 | 8/2006 | Difoggio et al. | |
| 7,096,961 | B2 | 8/2006 | Clark et al. | |
| 7,168,510 | B2 | 1/2007 | Boyle et al. | |
| 8,993,432 | | 1/2008 | Jenkins et al. | |
| 2002/0139584 | A1 | 10/2002 | Hughes et al. | |
| 2003/0056952 | A1 | 3/2003 | Stegemeier et al. | |
| 2003/0127252 | A1 | 7/2003 | Downton et al. | |
| 2006/0175056 | A1* | 8/2006 | Vercaemer | 166/250.12 |
| 2006/0225926 | A1 | 10/2006 | Madhavan et al. | |
| 2006/0260801 | A1 | 11/2006 | Hall et al. | |
| 2007/0063865 | A1 | 3/2007 | Madhavan et al. | |
| 2007/0144737 | A1 | 6/2007 | Mouget et al. | |
| 2007/0159351 | A1 | 7/2007 | Madhavan et al. | |
| 2007/0188344 | A1 | 8/2007 | Hache et al. | |
| 2008/0316049 | A1 | 12/2008 | Verret et al. | |
| 2009/0087911 | A1* | 4/2009 | Ramos | 436/27 |
| 2009/0145601 | A1* | 6/2009 | Bailey | 166/250.04 |
| 2009/0211754 | A1* | 8/2009 | Verret et al. | 166/250.12 |

* cited by examiner

SYSTEM AND METHOD OF MONITORING FLOW IN A WELLBORE

The present application is a continuation-in-part application and claims priority from U.S. patent application Ser. No. 11/995,518, entitled "Subsurface Tagging System With Wired Tubulars," filed on Dec. 13, 2007 now abandoned, which is hereby incorporated by reference in its entirety.

BACKGROUND

In a variety of wellbore drilling operations, drill bits are deployed on a drill string and used to cut through rock formations to create a wellbore. Operation of the drill bit creates cuttings that are removed by using drilling mud flowing downhole to clear the cuttings and to carry the cuttings uphole with the returning drilling mud. The cuttings can be used to obtain many types of information related to the drilling operation and to the subterranean environment.

Sometimes the term "mud-logging" is used to describe the capture and evaluation of cuttings from the drilling operation. Mud-logging comprises the recordation of cuttings lithology and wellbore gases at sequentially measured depths to create a log providing a lithological and gas record of the drilled wellbore. Accurate measurement of the depth at which the cuttings were produced is important for analysis of the drilling operation and subterranean environment. Generally, the depth from which the cuttings were made is calculated based on the volume of the wellbore annulus and the pump stroke rate of the mud pump used to deliver drilling mud. As the drill bit cuts through the rock, cuttings are released into the fluid stream of the flowing mud and subsequently collected at the surface for analysis. Ideally, the cuttings arrive at the surface one annulus volume later as measured by strokes of the mud pumps. The lag-time and knowledge of the annulus volume are used to estimate the depth at which the cuttings were produced.

However, the drilling operation often is conducted through a very dynamic environment with a variety of different processes that can affect the flow of fluid and therefore the transport of cuttings. For example, the flow of fluid and cuttings often can be disrupted which renders the depth determination indicated on the mud log subject to inaccuracies. Additionally, the wellbore can be washed-out and form wellbore sections having a larger gauge than the drill bit gauge. The larger sections change the wellbore annulus volume and again affect the accuracy of the calculated source depth of the cuttings returning to surface.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
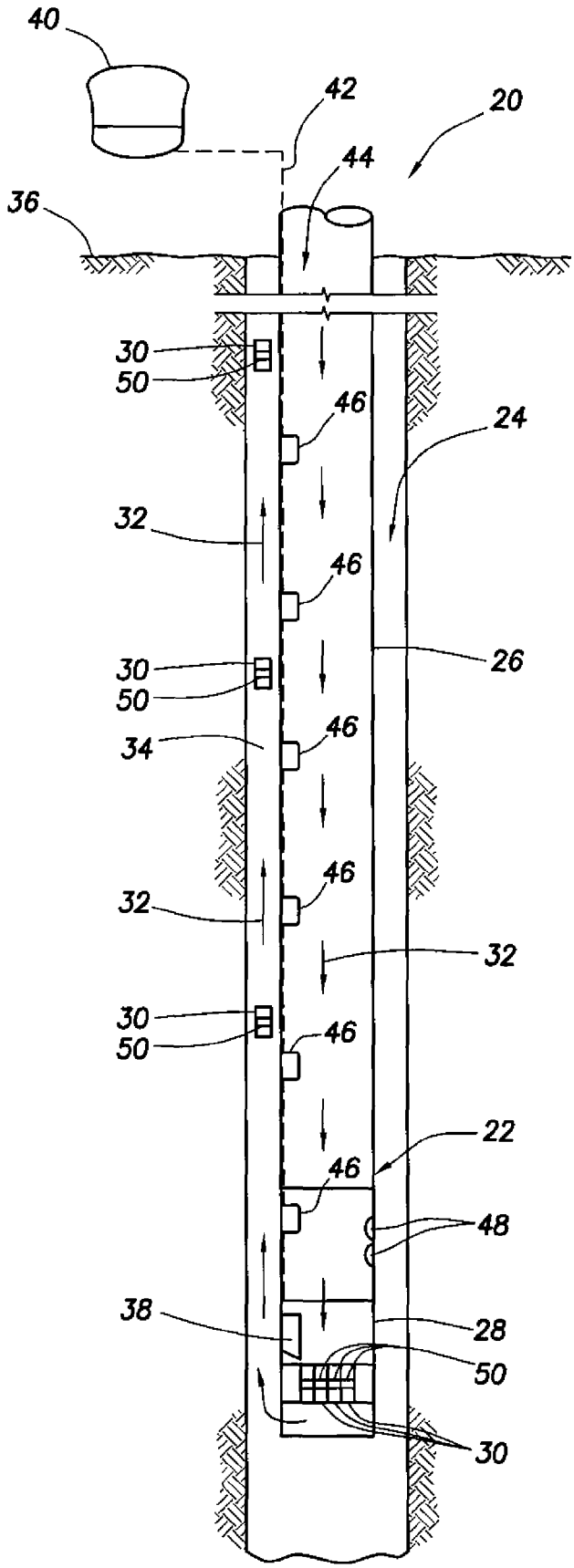
FIG. 1 is a schematic front view of a well system utilizing markers for monitoring fluid flow in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique that can be used to monitor and evaluate flow along a wellbore. In an embodiment, markers are released into a flow of fluid moving along a wellbore, and the positions of individual markers are detected to determine various characteristics regarding the flow, the wellbore, and/or the surrounding environment. For example, sensing the positions of individual markers as the markers move along the wellbore in the flow of fluid enables evaluation of fluid velocities, lag times, thief zones into which circulation is lost, and other well related parameters. With a known annular flow rate for a given annulus, the markers may be used to determine changes in annular velocity at specific wellbore regions to identify changes in wellbore gauge/volume.

The markers may be useful in measuring the transport of cuttings and/or other particles moving up or down along the wellbore. In drilling applications, for example, drilling fluid is flowing downward through a drill string and upward along the surrounding annulus to carry away cuttings produced by the drill bit and/or to maintain pressure within the wellbore. The markers may be released at any position along the drill string. For example, the markers may be released in the drilling fluid near the surface and flow down toward the drill hit. In such an example, the markers may be monitored as the markers flow downward toward the bit to identify actual or potential wash-outs as well as other properties related to the flow of the drilling fluid along the drill string. The markers may be monitored as they return to the surface. In another embodiment, the markers are released into the annulus and transported upward with the cuttings to the surface over a known and traceable time period independent of assumptions made to calculate the theoretical lag-depth. Detecting movement of the markers along the wellbore provides a monitoring system that is independent of idiosyncrasies of the dynamic wellbore environment and, in drilling applications, removes inherent mud-logging inaccuracies from lag-depth calculations.

In an embodiment, the markers are stored and deployed from a suitable marker tool, such as a deployment vessel or sub connected to a surface control system via a communication medium. In some well drilling applications, for example, a bottom hole assembly is deployed on a drill string formed of wired drill pipe, and the communication wires of the drill string can be used to carry signals from the surface control system to the marker tool to control the release of markers. This type of control system enables substantially real-time transmission of command signals to enable deployment of markers at specific points in time that accurately correspond with the existing depth data provided at the surface. The markers may be used to correct inaccuracies in the existing depth measurements.

The marker tool may be constructed in a variety of forms and configurations able to dependably release markers whether in groups or individually. By way of example, the marker tool may comprise a pneumatic actuator, a hydraulic actuator, an electronic actuator, or a mechanical actuator that can be selectively operated to eject individual markers into the fluid flow. The number, size, and type of markers positioned in the marker tool can vary depending on operational requirements and on the length and size of the wellbore fluid flow.

Referring generally to FIG. 1, an example of a well system 20 is illustrated according to an embodiment of the present invention. In this embodiment, the well system 20 comprises a well tool assembly 22 deployed in a wellbore 24 by a conveyance 26, such as a tubing string. The well tool assembly 22 may comprise a variety of components and configurations depending on the specific well related application for which it is deployed. However, the well tool assembly 22 comprises a marker tool 28 designed to selectively deploy markers 30 into a fluid flow, as represented by arrows 32.

In the embodiment illustrated, fluid flow 32 is directed down through tubing string 26 and well tool assembly 22 until being discharged into an annulus 34 for return to a surface location 36. The markers 30 may be selectively discharged into the fluid flow 32 for downward travel along the wellbore 24 and/or upward travel along the wellbore 24. In the illustrated example, the marker tool 28 is positioned at a downhole location, and the markers 30 are deployed into the fluid flow 32 at the downhole location for upward travel along annulus 34. The markers 30 may be individually deployed or two or more of the markers 30 may be simultaneously deployed. The marker tool 28 comprises an actuator 38 that may be controlled to deploy the markers 30 into the upwardly flowing fluid flow 32. As described above, the actuator 38 may be a pneumatic actuator, hydraulic actuator, electric actuator, mechanical actuator or another type of suitable actuator to enable controlled deployment of individual markers 30. It also should be noted that the fluid flow 32 can be directed along a variety of routes, e.g. down through an annulus and up through a tubing, depending on the specific well application.

In the example illustrated, the actuator 38 and the marker tool 28 are controlled via a control system 40, such as a processor based control system. The control system 40 may comprise a computer system located at surface 36 proximate the wellbore 24 or at a location remote from wellbore 24. Control signals can be sent to the marker tool 28 from the control system 40 via a communication line 42, which may comprise one or more electrical conductors, optical fibers, wireless media, or other types of communication media routed along tubing string 26 and well tool assembly 22.

The well system 20 further comprises a sensor system 44 that detects the position of the markers 30 and provides positional data that may be useful in evaluating flow characteristics, fluid characteristics, wellbore characteristics, and other well related characteristics. For example, the sensor system 44 may comprise a plurality of the sensors 46 deployed or positionable along the wellbore 24 and/or the tubing string 26. The sensors 46 may be positioned along, for example, the tubing string 26 and/or the well tool assembly 22, internally and/or externally, to detect the markers 30 as the markers 30 move into proximity with specific sensors. Additionally, the well system 20 also may comprise supplemental sensors 48 to obtain data on other well related parameters, such as temperature, pressure, density, gas content, and other parameters that can help evaluate and/or implement the operation of the well system 20.

The sensors 46 may detect the markers 30 and transmit positional data to the control system 40 via, for example, communication line 42. In one application, the data is used to determine the time passage and velocity for the markers 30 as the markers 30 move with fluid flow 32 from one of the sensors 46 to the subsequent one of the sensors 46. These measurements and others can be used in a variety of calculations to determine operational parameters related to the particular well application. For example, the sensors 46 may use the positional data to evaluate fluid velocities, lag times, thief zones into which circulation is lost, and other well related parameters. With a known annular flow rate for a given annulus, the markers 30 may be used to determine changes in annular velocity at specific wellbore regions to identify changes in wellbore gauge/volume.

The sensors 46 are positioned to detect the markers 30, and the sensors 46 may be designed in a variety of forms and configurations depending on the type of the markers 30 utilized in a given application. In one example, each of the markers 30 comprises a unique identifier 50, such as a radiofrequency identification (RFID) tag, which is uniquely detected and identified by each of the sensors 46. However, identification techniques other than RFID techniques may be used to identify specific markers 30, and the sensors 46 can be designed accordingly. The sensors 46 are able to register and/or record the passing of each marker 30 as it moves along fluid flow 32. The markers 30 may be detected along a range extending a predetermined distance before reaching the sensor 46 and a predetermined distance after passing the sensor 46. Alternatively, the markers 30 may be detected only while passing the sensor 46.

Additionally, the markers 30 can be made of various materials and can have various sizes and densities that are selected according to the environment in which the markers are released and according to objectives of a given fluid monitoring operation. The markers 30 may have different shapes, densities or size to, for example, measure and analyze the flowrate, transport rate, rheology of the markers 30 with respect to density, shape and size. Furthermore, the number of the markers 30 used for a given application and the frequency of release can vary from one application to another. In some applications, the control system 40 is programmed to release the markers 30 upon the occurrence of specific criteria that are detected by supplemental sensors 48, detected by surface sensors, or otherwise detected or observed. The control system 40 can be used to assign logic or to perform calculations for comparison and/or interpretation of information to determine the need for release of an additional marker or markers.

In addition to controlling the release of the markers 30, the control system 40 may be used to monitor and record the progress of the markers 30 along wellbore 24. In at least some applications, the control system 40 may be used to provide an indication, e.g. an alarm, when one or more of the markers 30 arrive at the surface. The control system 40 may operate an automated sample collection system to isolate cuttings samples from a specific depth or for a specific time period for collection at a later time. The control system 40 also may be used to process a variety of additional data, to evaluate numerous aspects of the overall operation, to perform modeling techniques, and to otherwise utilize information obtained from tracking the markers 30 and from other available sources, e.g. supplemental sensors 48.

Figure 2:
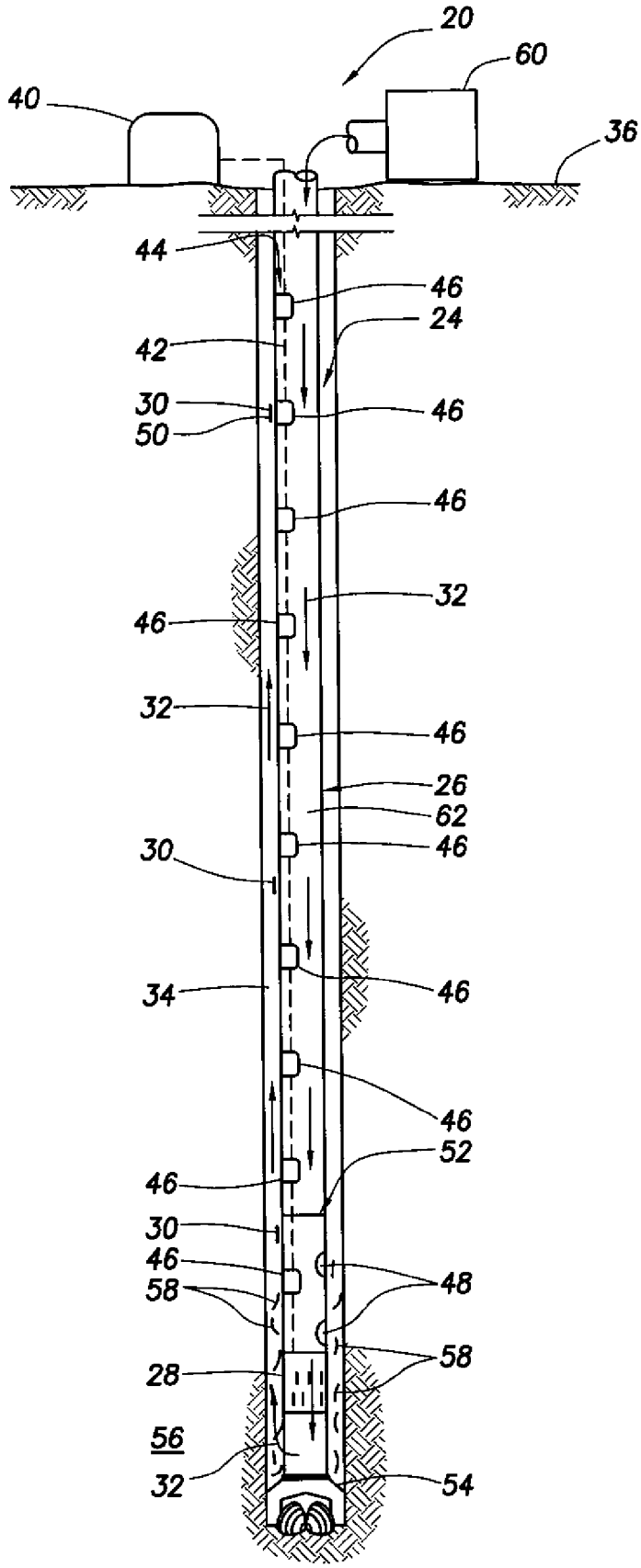
FIG. 2 is an example of the well system illustrated in FIG. 1, according to an alternate embodiment of the present invention.

Referring generally to FIG. 2, a specific application of the well system 20 is illustrated. In this embodiment, the well system 20 is designed to conduct a drilling operation and comprises a bottom hole assembly 52 used in drilling the wellbore 24. The bottom hole assembly 52 comprises a drill bit 54 which, when operated, drills into a rock formation 56 and creates cuttings 58. The cuttings 58 are removed by fluid flow 32 in the form of drilling fluid delivered via a fluid pump system 60 which may be located at surface 36. The fluid pump system 60 is operated to pump drilling mud down through tubing string 26 and out into annulus 34 proximate drill bit 54. The drilling fluid is circulated up through annulus 34 to move cuttings 58 to the surface 36.

By way of example, the tubing string 26 may comprise a drill string formed by wired drill pipe 62. The wired drill pipe 62 provides an open interior along which drilling mud is pumped downhole via mud pump 60 before being discharged into annulus 34. Additionally, the use of the wired drill pipe 62 provides an integral communication line 42 extending along the length of the wired drill pipe 62. As illustrated, the sensors 46 may be coupled to the individual or multiple signal carriers that form the communication line 42. For example, the sensors 46 may be mounted to the wired drill pipe 62 and connected to the communication line 42 either with direct connections or wireless connections. In an alternate embodiment, the sensors 46 can be integrally formed in wired drill pipe 62 and can provide data to control system 40 via the communication line 42. It should be noted that the communication line 42 also can be utilized for delivering signals from control system 40 to marker tool 28 or to other downhole devices. The present invention should not be deemed as limited to wired drill pipe or limited to an embodiment where the entire drill string comprises wired drill pipe, it is clearly contemplated that a portion of the drill string may comprise wired drill pipe, or the drill string may be non-wired.

In the embodiment illustrated in FIG. 2, the marker tool 28 may be positioned in the bottom hole assembly 52 for selective release of the markers 30 into the flowing drilling fluid. The markers 30 preferably flow in the direction of the drilling fluid, such as upwardly with cuttings 58. The markers 30 may be collected at the surface 36 by, for example, a screening device or other component capable of separating the markers 30 from the drilling fluid. By monitoring the movement of the markers 30 with the sensors 46, cuttings transport rate measurements can be obtained for determining cutting depth independently of assumed or estimated volumes and associated lag-times. Based on the tracking of the markers 30, other valuable information can be obtained regarding the flow of drilling fluid. For example, measuring and recording the actual cuttings transport rate and determining annular velocity of the drilling fluid can aid in hole cleaning and Rheological modeling. Additionally, the calculation of velocity between the sensors 46 enables the control system 40 to calculate wellbore volume and wellbore gauge changes at specific regions of the wellbore 24. This type of analysis also enables identification of thief zones based on, for example, changes in velocity and lost signals when a given marker is lost to the thief zone.

Figure 3:
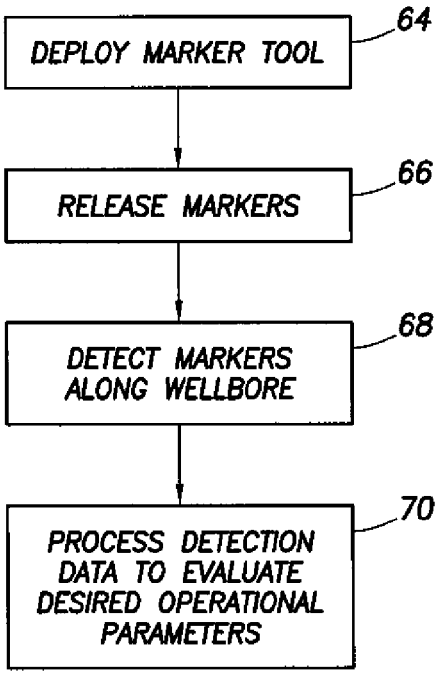
FIG. 3 is a flow chart illustrating a procedural application of the well system, according to an embodiment of the present invention.

The well system 20 is useful in a variety of wellbore applications and environments. One example of a general operational procedure utilizing the well system 20 is illustrated by the flowchart of FIG. 3. In this example, the marker tool 28 is deployed to a desired wellbore location, as represented by block 64. The markers 30 may be released into a fluid flow 32 moving along the wellbore, as represented by block 66. The markers 30 have unique identifiers 50, such as RFID tags, that can be detected by the sensors 46 positioned at desired or predetermined locations along wellbore 24, as indicated by block 68.

The markers 30 can be released into a variety of fluid flows depending on the specific type of well operation being conducted. As described above, the markers 30 may be released into a flow of drilling fluid, however the markers 30 also may be released into other types of fluid flows, including flows of production fluid, cleaning fluid or treatment fluid. For example, the markers 30 may be released into a flowing gravel slurry in a gravel packing operation to enable monitoring of placement and distribution of gravel in the completion. Similarly, the markers 30 may be released into a flow of cement during cementing operations to enable identification of the position of cement behind, for example, a casing. The cement position can be determined and recorded by sensors inserted into the casing, liner, or other tubular located inside or outside of the wellbore.

Regardless of the specific fluid flow into which the markers 30 are released, the sensors 46 can be used to detect movement of the markers 30 either in a downhole direction or in an uphole direction. However, in some applications, e.g. cementing applications, the markers 30 ultimately may be held in stationary positions and detected by moving sensors past the markers. It should further be noted that the sensor system 44 and the markers 30 can be utilized in deviated wellbores, e.g. horizontal wellbores, as well as generally vertical wellbores. In any of these applications, once data is obtained by the sensors 46 the data may be transmitted to the control system 40 for processing and/or analyzing. Depending on the specific well application, the control system 40 can be programmed to process and analyze the data to evaluate a variety of desired operational parameters, as represented by block 70.

Figure 4:
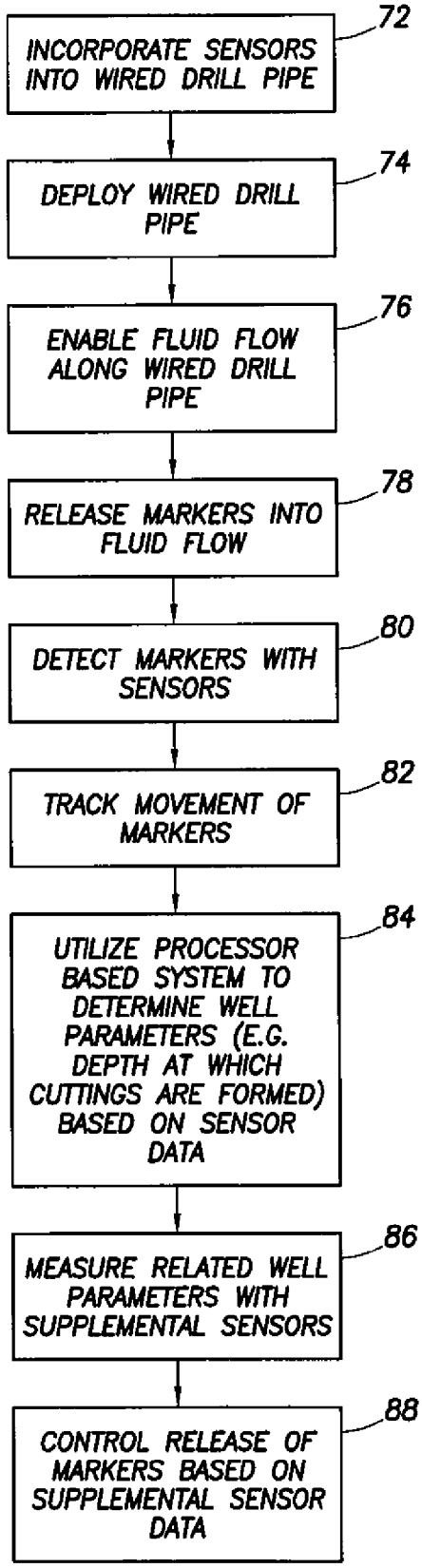
FIG. 4 is a flow chart illustrating another procedural application of the well system, according to an alternate embodiment of the present invention.

In another operational example, the well system 20 is designed for and utilized in a drilling operation, as represented by the flowchart of FIG. 4. In this example, the sensors 46 are incorporated on or into wired drill pipe 62, as represented by block 72. The wired drill pipe 62 is deployed downhole as the wellbore 24 is drilled via operation of drill bit 54, as represented by block 74. During drilling, fluid flow is established along the wired drill pipe 62 to remove cuttings, as represented by block 76.

The markers 30 may be released into the flowing fluid, e.g. drilling mud, as represented by block 78. The position of the markers 30 is detected by the sensors 46, as represented by block 80. Identification of specific markers with individual sensors enables the accurate tracking of marker movement, as represented by block 82. As described above, the data obtained by the sensors 46 may be processed by the control system 40 to determine desired well parameters, such as the depth at which cuttings are formed, as represented by block 84.

In some applications, related well parameters also can be measured with supplemental sensors 48, as represented by block 86. The supplemental data is processed to facilitate, for example, modeling techniques and other data analyses. However, the supplemental data obtained by sensors 48 also can be utilized by the control system 40 to automatically control the release of the markers 30 based on the detection of specific criteria, as represented by block 88.

Generally, the well system 20 can be employed in a variety of wellbore applications that utilize a flow of fluid. For example, the well system 20 is amenable to use in many types of drilling applications. The markers 30 are released into many types of flowing fluids in various well environments to facilitate evaluation and optimization of a given operation. Additionally, the markers 30 may comprise different types of unique identifiers detected by the appropriate type of corresponding sensor 46. Furthermore, the well system 20 may employ a variety of data processing systems, and the specific equipment, e.g. bottom hole assembly, deployed downhole can be adjusted according to the specific application.

Although only a few embodiments of the present invention have been described in detail above, those of ordinary skill in the art will readily appreciate that many modifications are possible without materially departing from the teachings of his invention. Accordingly, such modifications are intended to be included within the scope of this invention as defined in the claims.

What is claimed is:

1. A method, comprising:

positioning a sensor on a tubular within a wellbore;

positioning a supplemental sensor in the wellbore, the supplemental sensor configured to obtain well related data;

obtaining well related data from the supplemental sensor; and releasing a marker, based on the well related data, from a marker tool disposed within the wellbore, the releasing responsive to the marker tool receiving a signal communicated from a surface control system via wired drill pipe; and utilizing the sensor to detect movement of the marker along the wellbore;

wherein the well related data is not derived from the marker.

2. The method as recited in claim 1, further comprising processing data obtained from the sensor to determine positional data for the marker along the wellbore.

3. The method as recited in claim 2, wherein processing data comprises determining deviations in borehole volume and borehole gauge.

4. The method as recited in claim 2, wherein processing data comprises monitoring a cuttings transport rate.

5. The method as recited in claim 1, wherein releasing a plurality of markers from the marker tool into the wellbore, each marker having a different shape, size or density, and tracking different transport rates for cuttings having size, shape, or density corresponding to the size, shape, or density of the markers.

6. The method as recited in claim 1, wherein the sensor has a radiofrequency identification tags.

7. The method as recited in claim 1, wherein releasing comprises releasing the marker into drilling flow containing cuttings from a drilling operation; and further comprising the step of processing the data to determine movement of the cuttings.

8. The method as recited in claim 1, wherein the control system automates the collection of the markers at the surface.

9. The method as recited in claim 1, wherein releasing comprises releasing markers during a gravel packing operation to monitor distribution of gravel.

10. The method as recited in claim 1, wherein releasing comprises releasing markers during a cementing operation to identify the position of cement behind a casing.

11. A method, comprising:

positioning a tubing string, comprising wired drill pipe, in a wellbore and having a sensor deployed along the tubing string and communicatively coupled to the wired drill pipe;

deploying a computer system in communication with the sensor to obtain data from the sensor;

deploying a marker tool having a plurality of markers that may be selectively released into the wellbore, wherein the sensor detects the markers and relays positional information to the computer system; and releasing, by the marker tool, one or more of the plurality of markers based on data obtained from the computer system;

tracking different transport rates for cuttings having size, shape, or density corresponding to the size, shape, or density of the markers;

wherein at least one of the plurality of markers has a different shape, size or density.

12. The method as recited in claim 11, further comprising:

determining a depth at which cuttings are formed based on the positional information.

13. The method as recited in claim 11 further comprising:

positioning supplemental sensors along the wellbore to obtain drilling information.

14. The method as recited in claim 13, further comprising:

providing a control system to release the one or more markers based on the drilling information.

15. The method of claim 11, further comprising determining deviations in borehole volume and borehole gauge based on the positional information.

16. The method of claim 11, further comprising monitoring, via the sensor, the flow of the markers downward through the tubing string.

17. A system for monitoring a fluid flow in a wellbore, comprising:

a tubing string, comprising wired drill pipe, positioned in the wellbore and having a sensor deployed along the tubing string and communicatively coupled to the wired drill pipe;

a computer system in communication with the sensor to obtain data from the sensor; and a marker tool having a plurality of markers that may be selectively released into the wellbore, wherein the sensor detects the markers and relays positional information to the computer system;

wherein the marker tool releases one or more of the plurality of markers based on data obtained from the computer system;

wherein the tubing string comprises a supplemental sensor configured to obtain well related information not obtained from the markers; wherein the computer system is configured to cause the marker tool to release one of the markers based on the well related information.

18. The system as recited in claim 17, wherein at least one of the plurality of markers has a different shape, size or density than one of the other markers.

19. The system as recited in claim 17, wherein at least one of the plurality of markers comprises a radio frequency identification tag detectable by the sensor at a predetermined distance from each of the plurality of sensors.

20. The system of claim 17, wherein the sensor is integrally formed in the wired drill pipe.

21. The system of claim 17, wherein the marker tool comprises an actuator operable to selectively eject an individual marker into the wellbore.

* * * * *